US007259646B2

(12) United States Patent
Rab et al.

(10) Patent No.: US 7,259,646 B2
(45) Date of Patent: Aug. 21, 2007

(54) ELECTRICAL SERVICE DEVICE HAVING AN ARC PRECHAMBER AREA, PRECHAMBER PLATES AND A CURRENT-LIMITING ARC-QUENCHING DEVICE

(75) Inventors: Alexander Rab, Walldorf (DE); Klaus Kling, Schönau (DE); Patrick Claeys, Darmstadt (DE); Richard Kommert, Heidelberg (DE)

(73) Assignee: ABB Patent GmbH, Ladenburg (DE)

( * ) Notice: Subject to any disclaimer, the term of this patent is extended or adjusted under 35 U.S.C. 154(b) by 9 days.

(21) Appl. No.: 11/350,070

(22) Filed: Feb. 9, 2006

(65) Prior Publication Data

US 2006/0180576 A1 Aug. 17, 2006

(51) Int. Cl.
*H01H 9/30* (2006.01)

(52) U.S. Cl. ..... 335/201; 218/22; 218/23; 218/25; 218/155

(58) Field of Classification Search ..... 218/22, 218/23, 25, 26, 155, 158; 335/201
See application file for complete search history.

(56) References Cited

U.S. PATENT DOCUMENTS

| | | | | |
|---|---|---|---|---|
| 4,585,912 | A * | 4/1986 | Fischer et al. | 218/158 |
| 6,717,090 | B2 * | 4/2004 | Kling et al. | 218/151 |
| 7,145,422 | B2 * | 12/2006 | Imanishi et al. | 335/201 |

FOREIGN PATENT DOCUMENTS

| | | | |
|---|---|---|---|
| DE | 19518049 | A1 * | 11/1996 |
| DE | 10242310 | A1 * | 7/2003 |
| EP | 251160 | A2 * | 1/1988 |
| EP | 1056105 | A2 * | 11/2000 |

* cited by examiner

*Primary Examiner*—Ramon M. Barrera
(74) *Attorney, Agent, or Firm*—Buchanan Ingersoll & Rooney PC

(57) ABSTRACT

The invention proposes an electrical service device, in particular line circuit breaker or motor circuit breaker, having a housing having connection means (20, 21) for the purpose of connecting busbars and/or connection lines on at least one end side, having at least one switching contact having a fixed and a movable switching contact piece, an arc (6) being produced in an arc prechamber area (5) between said fixed and movable switching contact pieces in the event of a disconnection, said arc entering a current-limiting arc-quenching device (7) via arc guide rails. Prechamber plates (9, 12) are arranged in the region of the arc prechamber area (5), return-flow channels (10, 13) being formed by said prechamber plates (9, 12) from the arc-quenching device (7) to the arc prechamber area (5) between the housing wall (2) and the prechamber plates (9, 12). The housing wall (2) is provided with cutouts (15, 17), which are accessible from the outside, in the region of the prechamber plates (9, 12), iron plates (16, 18) being inserted into said cutouts (15, 17) for the purpose of creating an AC heavy-duty switching device and permanent magnet plates (16, 18) being inserted into said cutouts (15, 17) for the purpose of creating a DC heavy-duty switching device.

3 Claims, 2 Drawing Sheets

ELECTRICAL SERVICE DEVICE HAVING AN ARC PRECHAMBER AREA, PRECHAMBER PLATES AND A CURRENT-LIMITING ARC-QUENCHING DEVICE

The invention relates to an electrical service device having an arc prechamber area, prechamber plates and a current-limiting arc-quenching device in accordance with the precharacterizing clause of Claim 1. The invention can be used, for example, in line circuit breakers and motor circuit breakers.

Line circuit breakers and motor circuit breakers serve the purpose of isolating electrical lines, which are subjected to excess currents having a high current level, from the power supply system in the event of a fault. For this purpose, a fixed and a movable contact piece are generally provided in an arc prechamber area and are connected to the respective connection terminals. When the switching contact is opened, i.e. when the movable contact piece is lifted off from the fixed contact piece, a switching arc is produced which is quenched in a quenching device provided for this purpose. The arc drawn commutates from the open contact pieces onto arc guide rails in order to then be split in an arc splitter stack (Deion quenching chamber). A high arc voltage is produced there for current limiting purposes such that the arc is extinguished.

DE 102 42 310 A1 has disclosed an arc-quenching arrangement for an electrical switching device which comprises a quenching chamber (in which an arc is produced between a fixed and a movable contact piece in the event of a switching operation) and an arc splitter stack which has two or more arc splitter plates and into which the arc is guided via guide rails.

EP 0 251 160 B1 has disclosed a quenching device for an electrical switch having contact pieces arranged in a prechamber area and an arc splitter stack, the prechamber area being delimited laterally by prechamber plates. There is a gap between the outsides of the prechamber plates and the inner housing wall, and this gap allows the excess pressure to be guided back from the arc splitter stack without the development of the arc being disrupted. The wave of pressure flowing back is used for compensating for the low pressure and for deionization purposes in the contact region.

DE 195 18 049 A1 has disclosed an arc-quenching device of a switching device, in which an insulating-material arc splitter chamber is used in place of conventional arc splitter chambers, said insulating-material arc splitter chamber containing insulating-material webs which form gaps and into which an arc is pressed and thus extended. The quenching action is assisted by a magnetic blowing field which is produced with the aid of an iron plate. Such an iron plate can be arranged on one side of the entire chamber region (prechamber area/expansion region/quenching chamber region).

DE 199 24 414 A1 has disclosed an electrical service switching device, in the case of which a loop is provided on one side of the arc production region and has current flowing through it. One insulating-material plate is located on each side of the arc production region, and in each case one iron plate is arranged outside the insulating-material plates, one iron plate being at least partially surrounded on its outer circumference by the blowing loop. Owing to this arrangement, the blowing field produced by the loop is intensified and concentrated, as a result of which the arc is accelerated such that it enters an arc splitter stack more rapidly.

The invention is based on the object of specifying an electrical service device having an arc prechamber area, prechamber plates and a current-limiting arc-quenching device which has a simple design and optimum functionality.

This object is achieved according to the invention by the features specified in the characterizing clause of Claim 1 in conjunction with the features of the precharacterizing clause.

The advantages which can be achieved by the invention consist in particular in the fact that, as a result of the proposed measure, it is not necessary to decide as early as in the preliminary stages whether a standard switching device or a heavy-duty switching device with increased switching capacity is to be created. The housing has the same design for both types of switching devices; only additional iron plates or permanent magnet plates need to be latched onto the housing from the outside in the case of a heavy-duty switching device. As a result, economic and cost-saving manufacture is also possible for heavy-duty switching devices. In particular, no additional design measures are required in order to electrically insulate the iron plates or permanent magnet plates in order to thus prevent an arc from forming base points on these plates. It is advantageously possible in an extremely simple manner to retrospectively convert a standard switching device to a heavy-duty switching device. In particular, it is not necessary to open the switching device for this purpose.

Further advantages are described in the description below.

Advantageous refinements of the invention are characterized in the dependent claims.

The invention will be explained below with reference to the exemplary embodiments illustrated in the drawing, in which.

Figure 1:
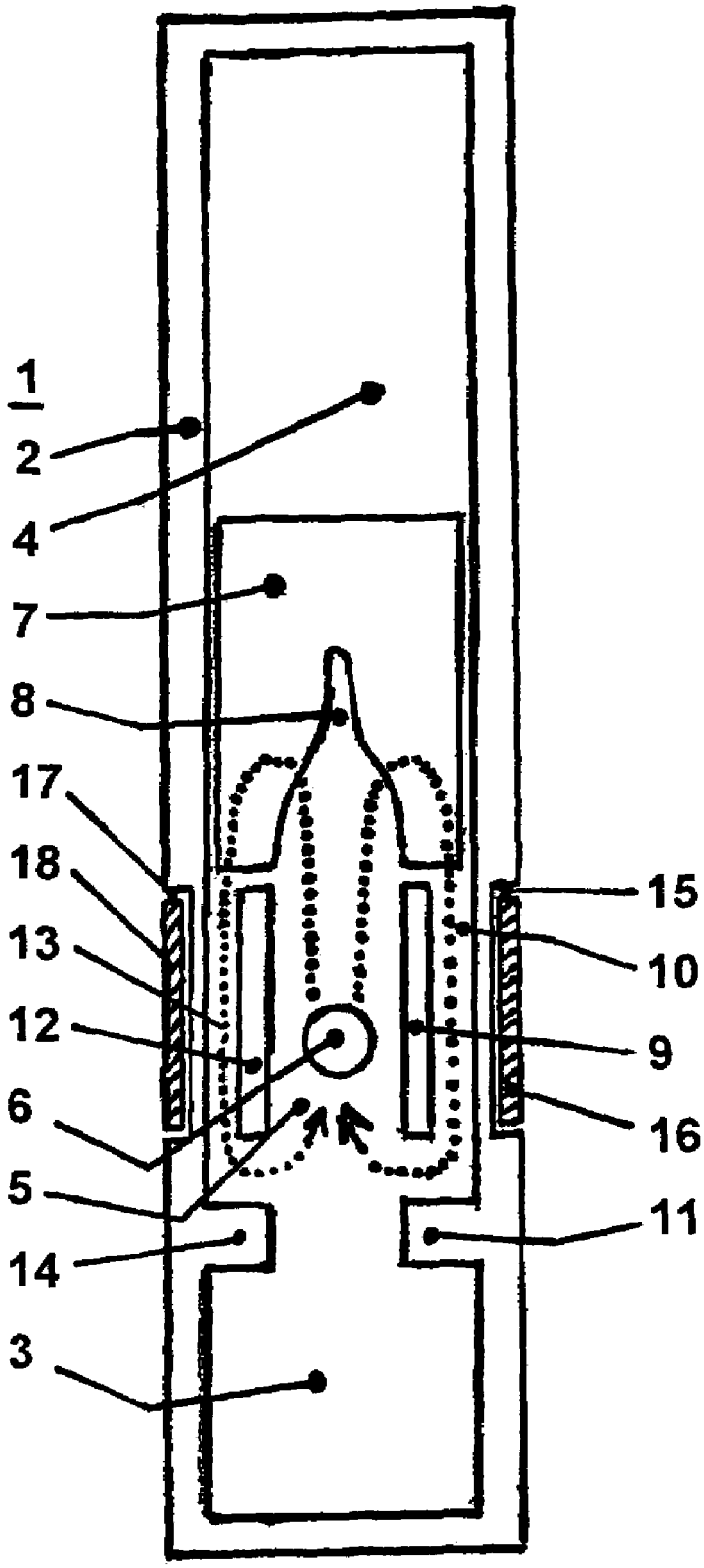
FIG. 1 shows a section through a switching device.

FIG. 1 shows a section through a switching device (heavy-duty switching device). Express reference is made to DE 102 42 310 A1 (mentioned at the outset) with respect to the design of such an electrical service device which can be mounted on a top-hat mounting rail. Such a switching device has, in a narrow, cuboid housing, on at least one end side, connection means for the purpose of connecting busbars and/or connection lines (input and output connections), an electromagnetic release for the purpose of disconnecting short-circuit currents, a thermal release for the purpose of disconnecting excess currents, a switching mechanism, a switching toggle on the upper side of the housing, at least one switching contact having at least one fixed and at least one movable switching contact piece, arc guide rails for the purpose of guiding an arc from an arc prechamber area into a current-limiting arc-quenching device and, on the base of the housing, mounting means for the purpose of fixing it to a top-hat mounting rail. If more than one switching contact is provided, arc-quenching devices including arc guide rails are of course also provided in a corresponding number.

The switching device 1—a line circuit breaker or a motor circuit breaker—has a housing made from an insulating plastic material which generally comprises two halves. A connecting area 3, a connecting area/area for (electromagnetic and thermal) releases 4 and an arc prechamber area 5 having an adjoining current-limiting arc-quenching device 7 (Deion chamber) are located within the interior surrounded by the housing wall 2—two narrow end sides and two broad sides can be seen.

Prechamber plates 9 and 12 made from an insulating material (such as a ceramic or a plastic) are arranged on both broad sides of the arc prechamber area 5 such that in each case one return-flow channel 10 and 13, respectively, is formed between the housing wall 2 and the prechamber plate 9 and 12, respectively. Deflections 11 and 14 guide the gases flowing through the return-flow channels 10 and 13, respectively, back to the arc prechamber area 5. The prechamber plates 9, 12 are arranged geometrically such that a return flow behind these prechamber plates is only made possible in the expansion region of the arc, as a result of which the arc is accelerated in the direction of the arc-quenching device 7.

An arc 6 occurring within the arc prechamber area 5 migrates to the arc-quenching device 7, which is generally provided with inner cutouts 8. Two gas flows (illustrated using dotted lines) result on the basis of the circulation principle:

- a first gas flow from the arc prechamber area 5 with the arc 6 via the arc-quenching device 7 and through the return-flow channel 10 back into the arc prechamber area 5.
- A second gas flow from the arc prechamber area 5 with the arc 6 via the arc-quenching device 7 and through the return-flow channel 13 back into the arc prechamber area 5.

In addition, a force acts on the arc 6 in the direction of a weaker magnetic field, in this case, as a result of a corresponding design of the arc splitter plates of the arc-quenching device 7, in the direction towards the arc-quenching device 7. This force effect is intensified by the fact that iron plates 16 and 18, respectively, in the case of AC heavy-duty switching devices, and permanent magnet plates 16 and 18, respectively, in the case of DC heavy-duty switching devices, are in each case arranged outside the prechamber plates 9 and 12, respectively. In order to fix these plates 16 and 18, respectively, the housing wall 2 is provided in each case with a cutout 15 and 17, respectively, which is accessible from the outside, in the region of the prechamber plates 9 and 12, respectively. Without any additional measures, the housing wall 2 advantageously provides sufficient electrical insulation between the arc prechamber area 5 and the iron plates or permanent magnet plates 16, 18.

In each case one iron plate or permanent magnet plate 16 or 18 is inserted into the cutout 15 or 17 and latched or adhesively bonded there so as to create a heavy-duty switching device having an increased switching capacity compared to a standard switching device. If a more cost-effective standard switching device is intended to be created, these iron plates or permanent magnet plates are dispensed with.

Figure 2:
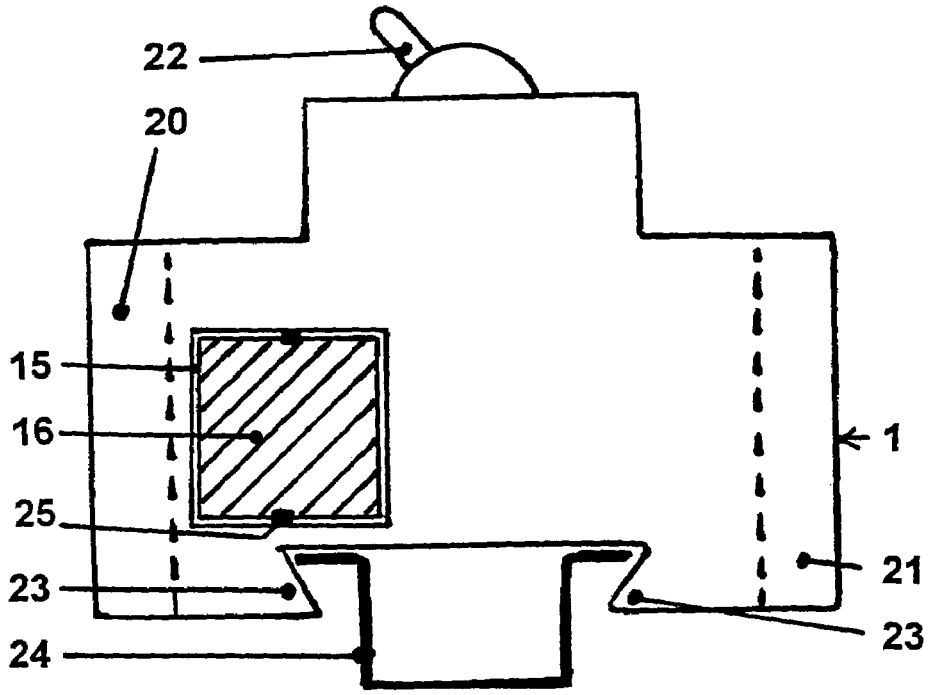
FIG. 2 shows a side view of a heavy-duty switching device.

FIG. 2 shows a side view of a heavy-duty switching device. Connection means 20, 21 are provided on both end sides of the housing of the switching device 1 for the purpose of connecting busbars and/or connection lines. An iron plate or permanent magnet plate 16 is inserted into the cutout 15, the plate being latched by means of latching means (latching tabs) 25. A switching toggle 22, which is to be used for manual switching operations, is located on the upper side of the housing. Mounting means 23 (fixed tab+movable tab) are arranged on the base of the housing for the purpose of fixing the switching device 11 on a top-hat mounting rail 24.

Figure 3:
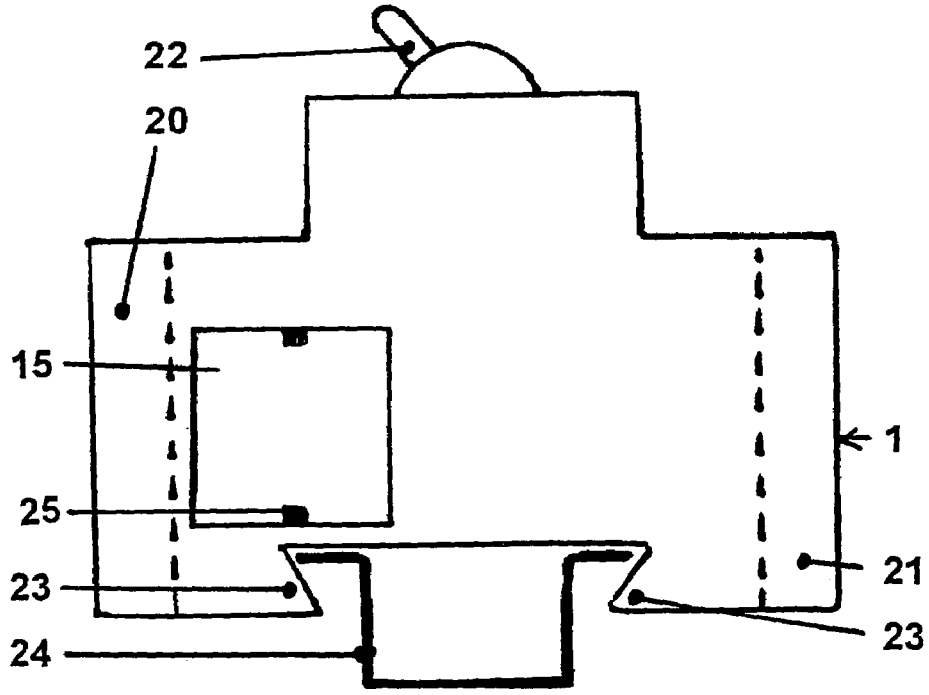
FIG. 3 shows a side view of a standard switching device.

FIG. 3 shows a side view of a standard switching device. In contrast to the switching device illustrated in FIG. 2, in this case the iron plates or permanent magnet plates 16 are dispensed with such that the cutouts 15, 17 remain open. The further design of the switching device is as described for FIG. 2.

LIST OF REFERENCES

1 Switching device
2 Housing wall of a housing made from an insulating plastic
3 Connecting area
4 Connecting area/area for release
5 Arc prechamber area
6 Arc
7 Current-limiting arc-quenching device, Deion chamber
8 Inner cutout
9 Prechamber plate
10 Return-flow channel
11 Deflection in housing wall
12 Prechamber plate
13 Return-flow channel
14 Deflection in housing wall
15 Cutout in housing wall
16 Iron plate or permanent magnet plate
17 Cutout in housing wall
18 Iron plate or permanent magnet plate
19 - - -
20 Connection means
21 Connection means
22 Switching toggle
23 Mounting means
24 Top-hat mounting rail
25 Latching means

The invention claimed is:

1. Electrical service device, having a housing having connection means for the purpose of connecting busbars and/or connection lines on at least one end side, having at least one switching contact having a fixed and a movable switching contact piece, an arc being produced in an arc prechamber area between said fixed and movable switching contact pieces in the event of a disconnection, said arc entering a current-limiting arc-quenching device via arc guide rails, prechamber plates being arranged in the region of the arc prechamber area, return-flow channels being formed by said prechamber plates from the arc-quenching device to the arc prechamber area between the housing wall and the prechamber plates, wherein the housing wall is provided with cutouts, which are accessible from the outside, in the region of the prechamber plates, iron plates being inserted into said cutouts for the purpose of creating an AC heavy-duty switching device or permanent magnet plates being inserted into said cutouts for the purpose of creating a DC heavy-duty switching device.

2. Service device according to claim 1, wherein latching means are provided at the edges of the cutouts for the purpose of locking the inserted iron plates or permanent magnet plates.

3. Service device according to claim 1, wherein the inserted iron plates or permanent magnet plates are adhesively bonded to the housing wall.

* * * * *